US011278105B2

(12) United States Patent
Lutin

(10) Patent No.: US 11,278,105 B2
(45) **Date of Patent: *Mar. 22, 2022**

(54) COMBINATION BACKPACK AND BABY CARRIER

(71) Applicant: InnovKids Products, LLC, Wheeling, IL (US)

(72) Inventor: Una Lutin, Chicago, IL (US)

(73) Assignee: InnovKids Products, LLC, Wheeling, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/173,021

(22) Filed: Feb. 10, 2021

(65) Prior Publication Data

US 2021/0315365 A1 Oct. 14, 2021

Related U.S. Application Data

(63) Continuation of application No. 16/846,640, filed on Apr. 13, 2020, now Pat. No. 10,945,518.

(51) Int. Cl.
*A45F 4/02* (2006.01)
*A47D 13/02* (2006.01)
*A45F 3/00* (2006.01)

(52) U.S. Cl.
CPC ..... *A45F 4/02* (2013.01); *A47D 13/02* (2013.01); *A45F 2003/003* (2013.01); *A47D 13/025* (2013.01)

(58) Field of Classification Search
CPC ..... A45F 3/04; A45F 4/02; A45F 2003/003; A47D 13/02; A47D 13/025
USPC ..... 224/159, 160
See application file for complete search history.

(56) References Cited

U.S. PATENT DOCUMENTS 278,437 A * 5/1883 Lancaster ..... A47D 13/02 224/158
2,804,249 A * 8/1957 Manalo ..... A47D 13/02 224/158
4,402,440 A * 9/1983 Purtzer ..... A47D 13/025 224/159
4,492,326 A * 1/1985 Storm ..... A47D 13/025 224/159
4,778,091 A * 10/1988 Barto ..... A45F 3/08 224/158
5,071,047 A * 12/1991 Cordisco ..... A47D 13/025 224/158
5,148,956 A * 9/1992 Funk ..... A01K 1/0263 119/725
D332,865 S * 2/1993 Wilmink ..... 224/158
5,522,528 A * 6/1996 Petricola ..... A47D 13/025 224/160

(Continued)

OTHER PUBLICATIONS https://littlefolksnyc.com/products/nuna-cudl-baby-carrier-2020?variant=31567632302193, downloaded May 6, 2021, 2 pages.

*Primary Examiner* — Justin M Larson
(74) *Attorney, Agent, or Firm* — Seyfarth Shaw LLP

(57) ABSTRACT

Disclosed is a combination bag and baby carrier that couple together via a harness. The bag and carrier removably couple to the harness with clips and snaps, for example, to allow the use of the bag and carrier at the same time but also to allow the bag to be removed and the user to rest while holding their baby in the carrier. In an embodiment, a sling carrier can be used and is coupled to the harness to hold the baby in a sling-type arrangement.

14 Claims, 9 Drawing Sheets

(56) References Cited

U.S. PATENT DOCUMENTS

| | | | | | |
|---|---|---|---|---|---|
| 5,685,466 | A * | 11/1997 | Hsieh | A47D 13/025 | 224/159 |
| 5,819,341 | A * | 10/1998 | Simantob | A47D 11/005 | 5/98.1 |
| 6,213,362 | B1 * | 4/2001 | Lorenzini | A47D 13/02 | 224/158 |
| 6,866,173 | B2 * | 3/2005 | Haber | A45F 3/04 | 224/160 |
| 7,614,533 | B2 * | 11/2009 | Boal | A47D 13/025 | 224/159 |
| 9,439,515 | B2 * | 9/2016 | Kim | A47D 13/025 | |
| D825,915 | S * | 8/2018 | Workman | D3/214 | |
| 10,716,411 | B2 * | 7/2020 | Plested | A47D 13/025 | |
| 10,750,879 | B2 * | 8/2020 | Schachtner | A47D 13/025 | |
| 10,945,518 | B1 * | 3/2021 | Lutin | A47D 13/02 | |
| 2004/0065708 | A1 * | 4/2004 | Amram | A45F 3/047 | 224/579 |
| 2007/0062988 | A1 * | 3/2007 | Kassai | A47D 13/025 | 224/158 |
| 2016/0128491 | A1 * | 5/2016 | Martiniuk | B62B 9/24 | 280/47.41 |
| 2018/0008024 | A1 * | 1/2018 | Barton | A45F 5/00 | |
| 2020/0085175 | A1 * | 3/2020 | Cotirla | A45F 4/02 | |
| 2020/0113350 | A1 * | 4/2020 | Warner | A45F 3/04 | |
| 2020/0330317 | A1 * | 10/2020 | Zhijian | A47D 13/025 | |
| 2021/0315365 | A1 * | 10/2021 | Lutin | A45F 3/04 | |

* cited by examiner

COMBINATION BACKPACK AND BABY CARRIER

TECHNICAL FIELD OF THE INVENTION

The presently disclosed embodiments relate generally to storage and carrying devices. More particularly, the presently disclosed embodiments relate to a combination backpack and baby carrier coupled via a harness.

BACKGROUND OF THE INVENTION

Wearable storage is commonplace in today's society. Consumers wear purses, backpacks, satchels, and other bags as a means to store personal contents and possessions. These bags include fasteners such as zippers, buttons, or snaps that allow the wearer to removably store contents within a main compartment. Often, these bags include smaller, secondary compartments with similar fasteners. For example, parents often wear bags when traveling with children. Parents store snacks, bottles, diapers, and other contents in their bags for easy retrieval when needed.

Parents also use various devices for transporting or holding their children. For example, parents use strollers to push their child, or attached baby carriers (e.g., Baby Bjorn®)) that help keep their child close to them. These carriers are typically secondary items that are independent from the bags parents often carry with them and are neither integrated with the bags nor functional with the bags in any synergistic manner.

SUMMARY OF THE INVENTION

The presently disclosed embodiments broadly comprise a combination bag and baby carrier that are coupled together via a harness. The bag includes clips, snaps, or other fasteners that connect with corresponding fasteners on the harness to removably couple the bag to the user. The harness can further couple to a baby carrier to removably couple the bag and carrier together via the harness. In an embodiment, a sling carrier can be coupled to the harness in a novel manner to allow removable coupling of a sling carrier with the bag via the harness.

For example, the presently disclosed embodiments broadly comprise a combination including a bag having a main compartment having front and rear sides, bag snaps extending from the main compartment on the front side, first and second bag clips extending from the main compartment above the bag snaps, and third and fourth bag clips extending from the main compartment below the bag snaps. The combination can further include a harness having first and second shoulder straps, harness snaps extending from the first and second shoulder straps and corresponding to and configured to couple to the bag snaps, first and second harness clips extending from the shoulder straps above the harness saps and adapted to couple to the first and second bag clips, third and fourth harness clips extending below the harness snaps and configured to couple to the third and fourth bag clips, and fifth and sixth harness clips extending from the shoulder straps proximate the first and second harness clips. The combination can still further include a carrier having a main body, a lower body extending from the main body, first and second carrier clips extending from the lower body and coupling together around the waist of a wearer, and third and fourth carrier clips configured to couple to the fifth and sixth harness clips.

The presently disclosed embodiments can further broadly comprise a combination including a bag having a main compartment having front and rear sides, bag snaps extending from the main compartment on the front side, first and second bag clips extending from the main compartment above the bag snaps, and third and fourth bag clips extending from the main compartment below the bag snaps. The combination can further include a harness having first and second shoulder straps, harness snaps extending from the first and second shoulder straps and corresponding to and configured to couple to the bag snaps, first and second harness clips extending from the shoulder straps above the harness saps and adapted to couple to the first and second bag clips, third and fourth harness clips extending below the harness snaps and configured to couple to the third and fourth bag clips, and fifth and sixth harness clips extending from the shoulder straps proximate the first and second harness clips. The combination can still further include a sling carrier having a sling body made of fabric, and first and second sling carrier clips extending from opposite sides of the sling body and configured to couple to the fifth and sixth harness clips.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
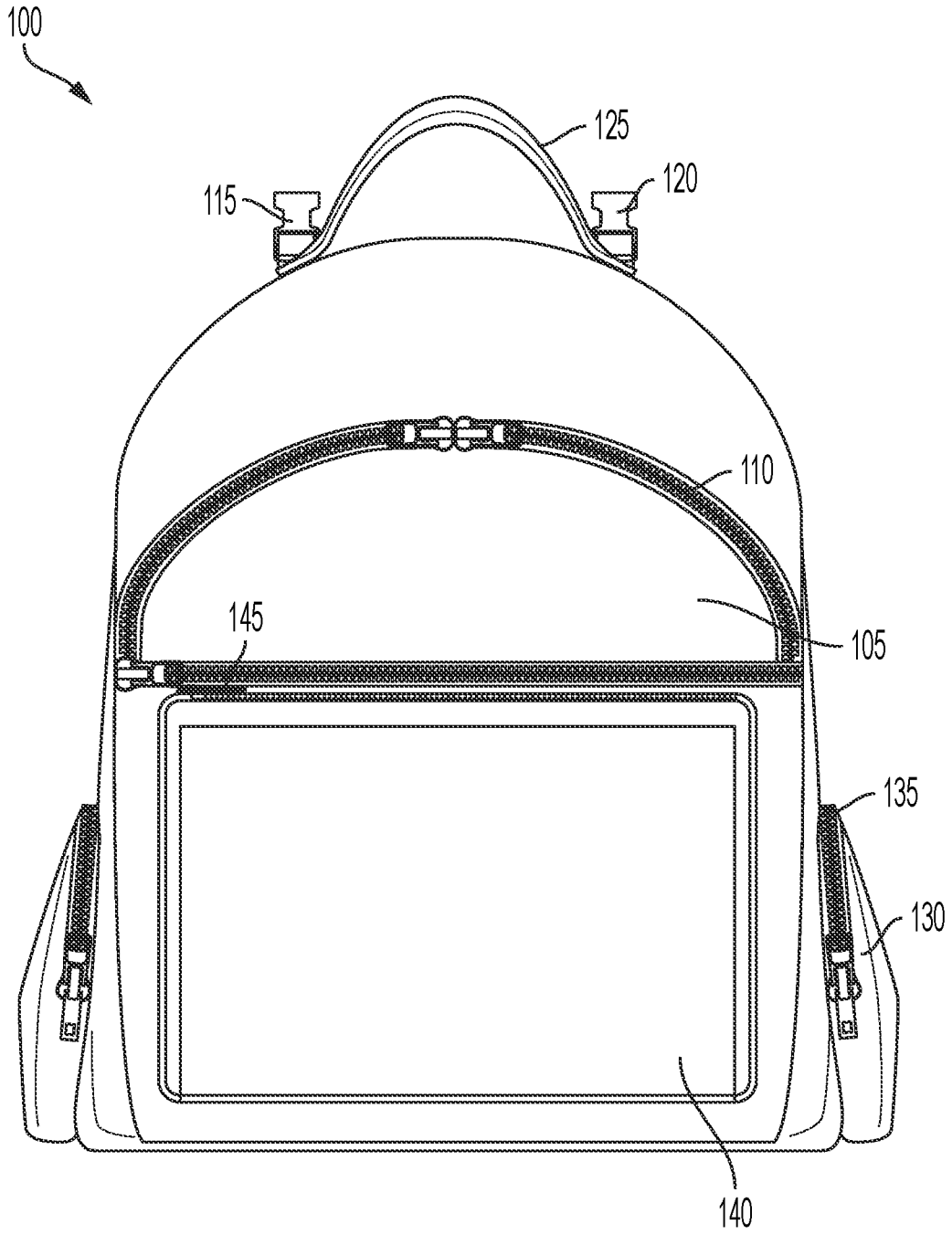
FIG. 1 is a rear view of a bag according to at least some of the presently disclosed embodiments.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the terms "present invention" and "presently disclosed embodiments" are not intended to limit the scope of the claimed invention and are instead terms used to discuss exemplary embodiments of the invention for explanatory purposes only.

The presently disclosed embodiments include a combination bag and baby carrier that couple together via a harness. The bag and carrier removably couple to the harness with clips or other fasteners to allow the use of the bag and carrier at the same time. In an embodiment, a wrap carrier can be used and is coupled to the harness in a novel manner.

FIG. 1 illustrates a front view of a bag 100 according to at least some of the presently disclosed embodiments. As shown in FIG. 1, the bag 100 can include a main compartment 105 enclosable by a main fastener 110. The bag 100 can couple with a harness, as discussed below in more detail, at a first bag clip 115 and/or second bag clip 120 located near a top portion of the bag 100. For example, the first 115 and second bag clips 120 can be female clips that couple with corresponding male clips of the harness, as discussed below in more detail. A handle 125 can also be coupled to the bag 100 to allow the user to easily grip the bag 100 when the bag 100 is not being worn. As shown, the bag 100 can further include a side compartment 130 with a side fastener 135 for storing smaller objects such as keys or a phone, for example. The side compartment 130 can also be sized to store the carrier or harness, in some embodiments. The front of the bag 100 can further include a front compartment 140 with a front fastener 145 for storing other small objects or for storing the carrier or harness, for example.

Figure 2:
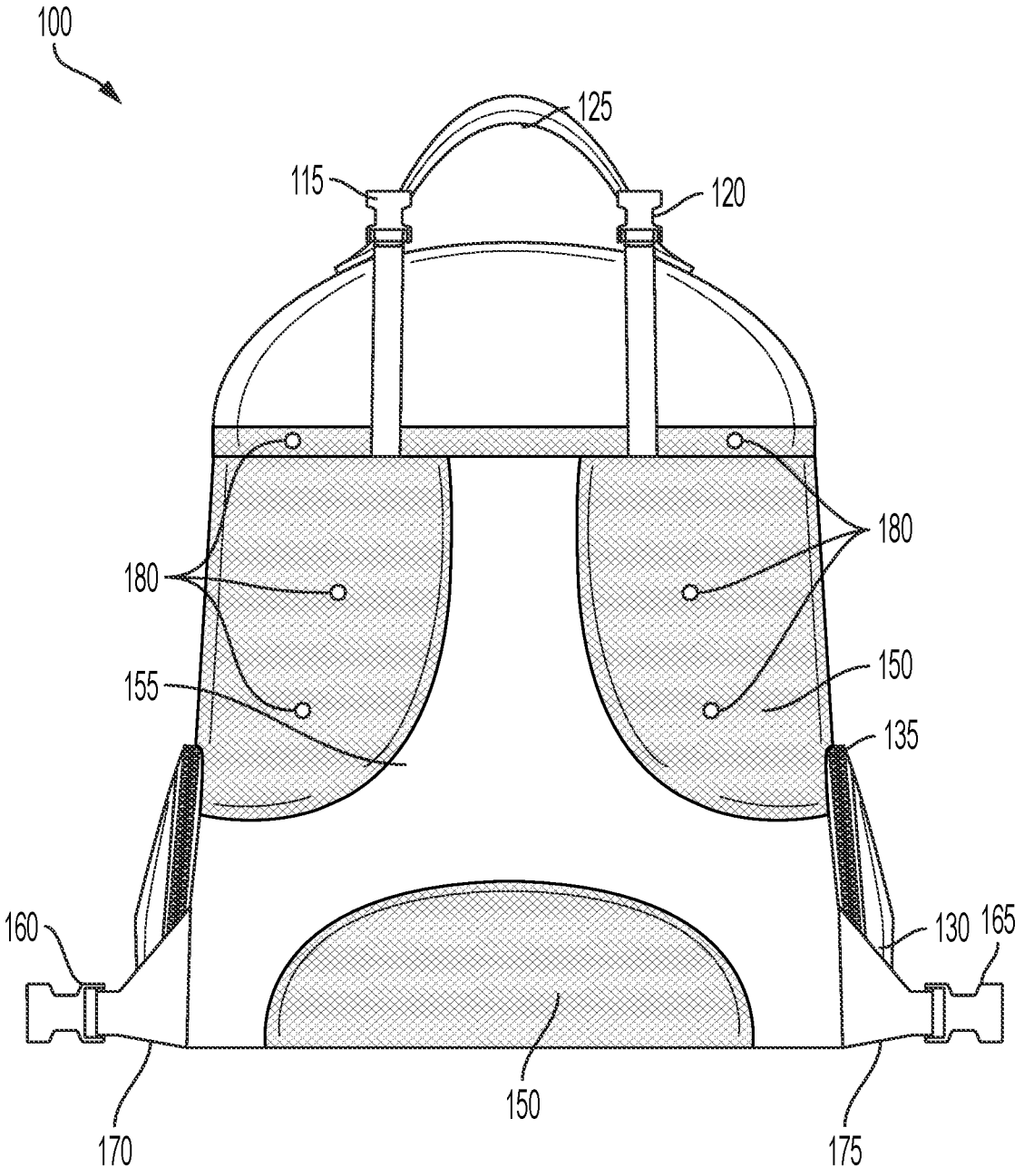
FIG. 2 is a front view of the bag according to at least some of the presently disclosed embodiments.

FIG. 2 is a rear view of the bag 100 according to at least some of the presently disclosed embodiments. As shown, the bag 100 can further include one or more pads 150 that create a more comfortable user experience for the wearer, and that extend across the back of the bag 100. As shown, the pad 150 can align with the lower back of the user and also with the user's shoulder blades, but any shape or size pad 150, or no pad 150 at all, may be implemented without departing from the spirit and scope of the present invention. For example, the pads 150 that align with the user's shoulder blades may be unnecessary due to padding in the shoulder straps of the harness. A bag base 155 can extend both vertically and horizontally across the rear of the bag 100.

The bag 100 may include various fasteners that couple to the harness. For example, as discussed above, the first 115 and second 120 bag clips located proximate the top of the bag 100 may couple to corresponding clips in the harness to increase structural stability of the coupling between the two elements. The bag 100 can also include third 160 and fourth 165 bag clips located proximate a bottom of the bag 100 that couple with corresponding clips in the harness. The third 160 and fourth 165 bag clips may extend from or be coupled to first 170 and second 175 flaps, respectively, to allow for additional flexibility for the directional orientation of the third 160 and fourth 165 bag clips. Various bag snaps 180 may be provided that couple to corresponding snaps on the harness to provide coupling therebetween.

Figure 3:
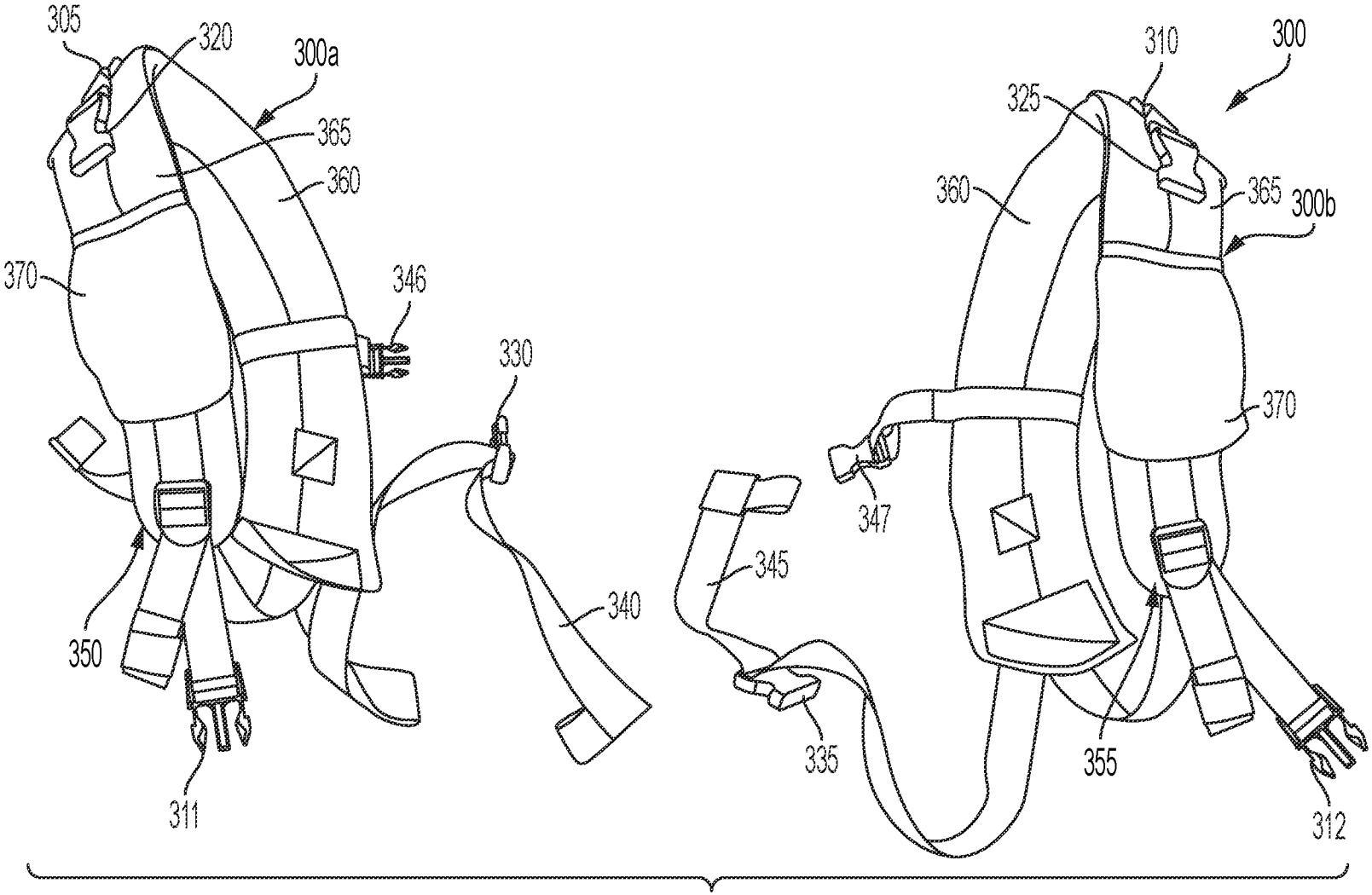
FIG. 3 is a front view of a harness according to at least some of the presently disclosed embodiments.
Figure 4:
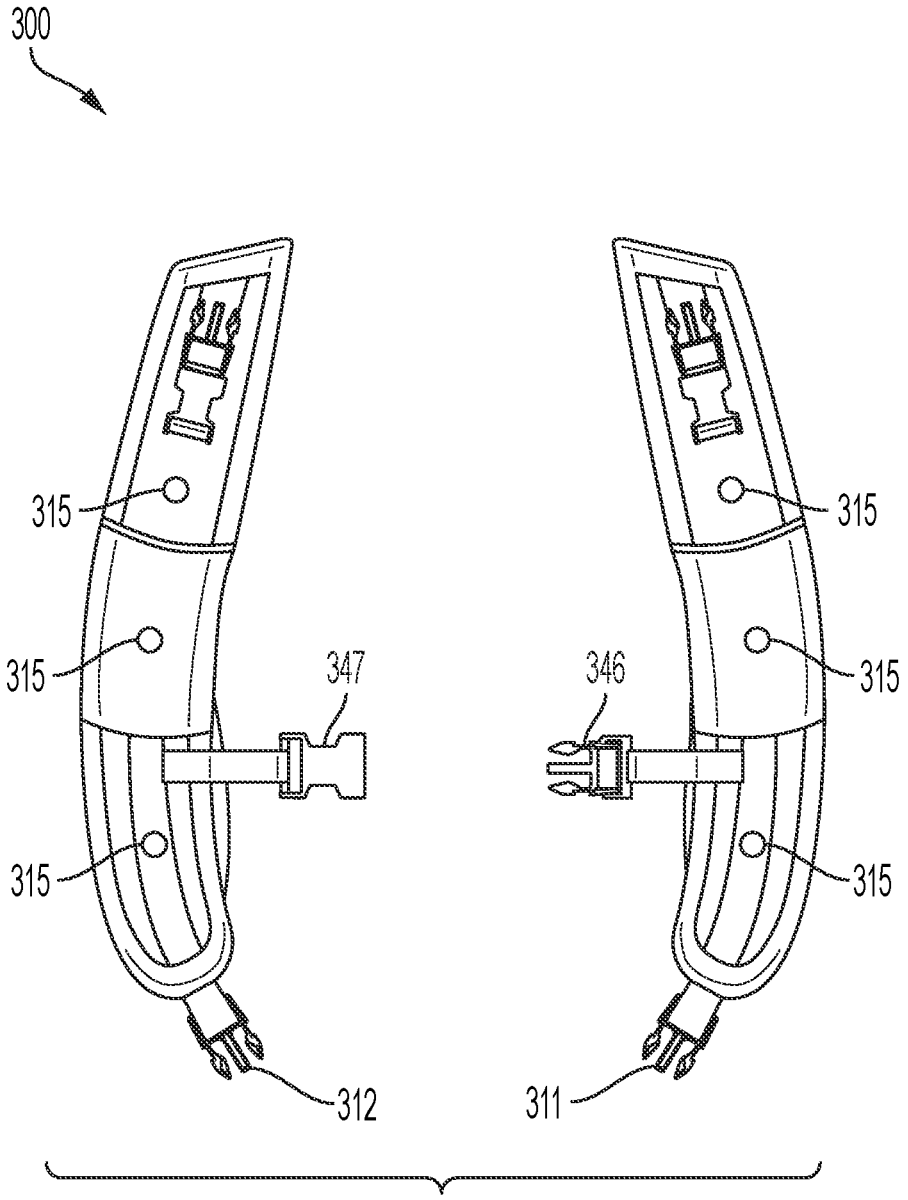
FIG. 4 is a rear view of the harness according to at least some of the presently disclosed embodiments.

FIG. 3 is a rear view of a harness 300 and FIG. 4 is a front view of a harness 300, according to at least some of the presently disclosed embodiments. As shown, the harness 300 includes first 300*a* and second 300*b* harness portions, each of which couple to the bag 100 and to a carrier. For example, the harness 300 can include first 305 and second 310 harness clips that mate with the first 115 and second 120 bag clips to provide coupling therebetween at an upper portion of both the bag 100 and harness 300. Third 315 and fourth 320 harness clips can further be provided at a lower portion of the harness 300 to couple with the third 160 and fourth 165 bag clips at the lower portion of the bag 100 and hardness 300. Harness snaps 315 are provided and face rearward to couple with corresponding bag snaps 180 on the bag 100. Fifth 320 and sixth 325 harness clips can further be provided on the harness 300 to couple with corresponding clips at an upper portion of the carrier; and seventh 330 and eighth 335 harness clips can couple to corresponding clips at a mid-section of the carrier, as discussed below in more detail. The seventh 330 and eighth 335 harness clips can be adjustably coupled to adjustment straps 340, 345 to allow adjustment thereof and to facilitate the holding of different sized babies. A first head clip 346 can couple to a second head clip 347 to provide further structural support to the head of the baby when carried, as discussed below in more detail.

The harness 300 can be carried by a user based on first 350 and second 355 shoulder straps that are worn similar to a conventional backpack. For example, and as shown, the harness 300 can include an inner strap portion 360 located proximate the bag 100 and coupled thereto, and an outer strap portion 365 located away from the bag 100. The inner 360 or outer 365 strap portions may be padded to allow further comfort to the user. For example, the outer strap portion 365 may include padding located inside the shoulder strap 355 to improve comfort on the wearer's shoulders. As shown, the outer strap portion 365 may further include a slot 370 for insertion of user accessories such as a cellular phone.

Figure 5:
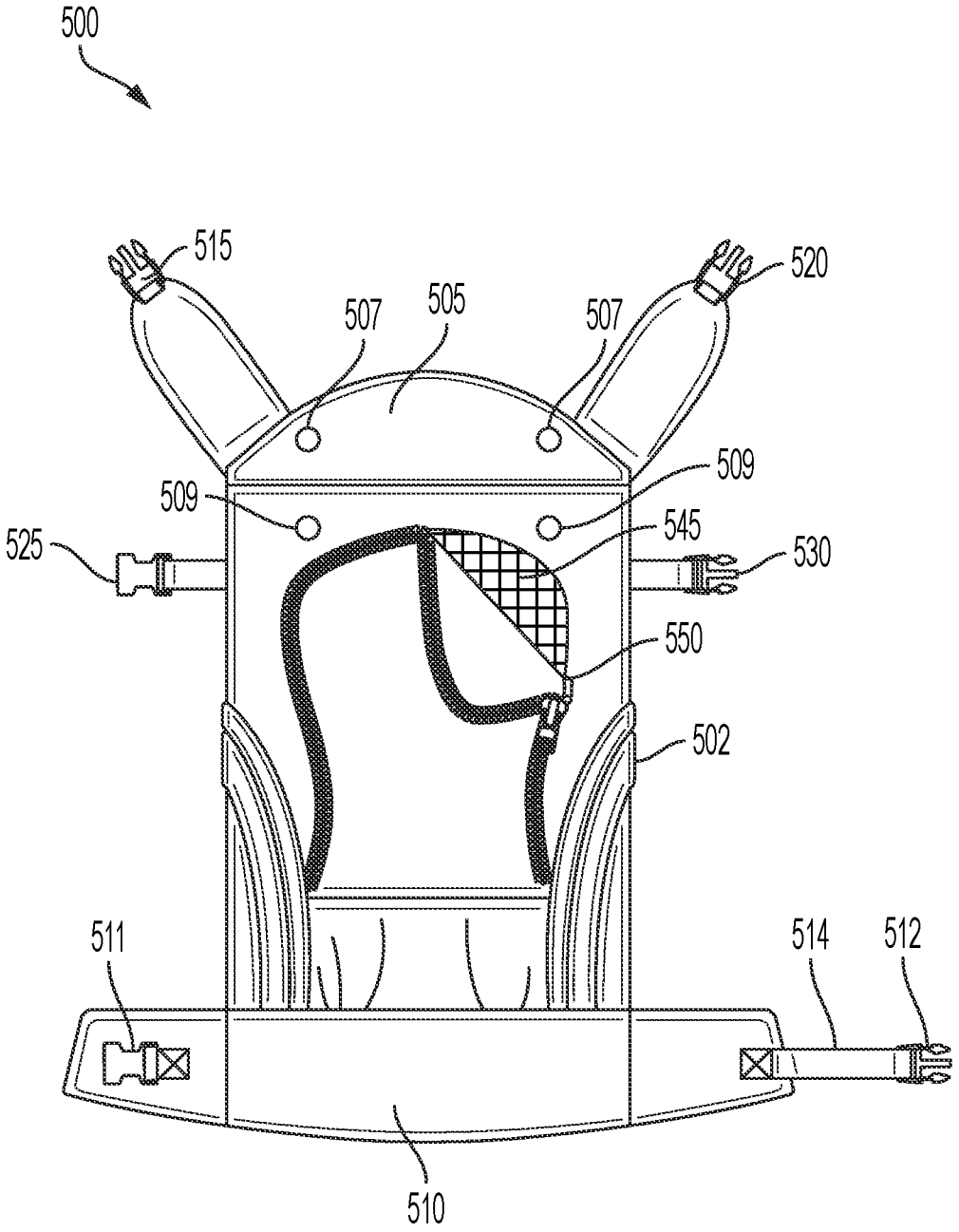
FIG. 5 is a front view of a carrier according to at least some of the presently disclosed embodiments.
Figure 6:
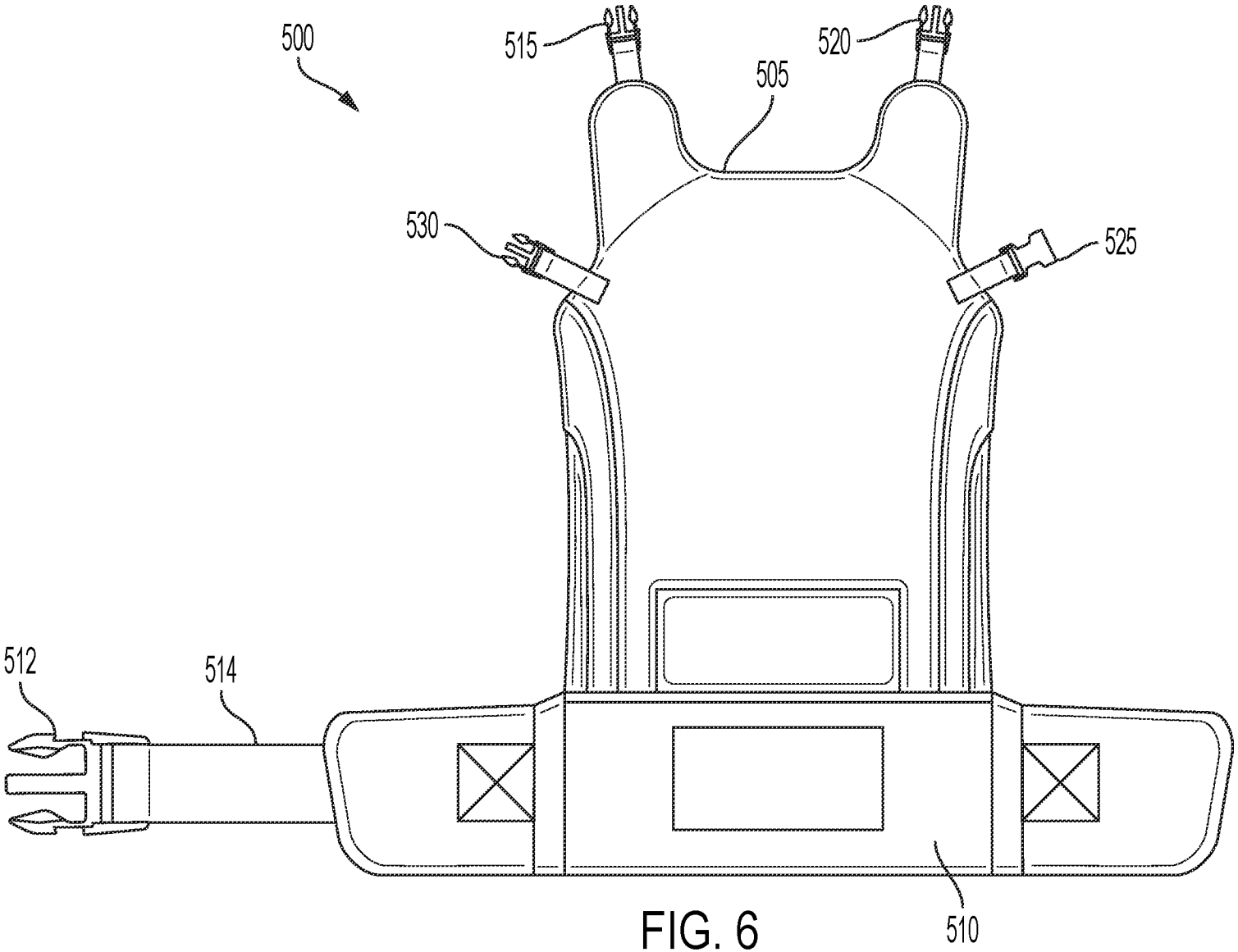
FIG. 6 is a rear view of a carrier according to at least some of the presently disclosed embodiments.

FIG. 5 is a front view of a carrier 500, and FIG. 6 is a rear view of the carrier 500, according to at least some of the presently disclosed embodiments. As shown, the carrier 500 includes a main body 502 with an upper body 505 extending therefrom. The upper body 505 includes a neck clasp 507 connectable to a lowering clasp 509 on the main body 502 below. The upper body 505 is generally for the purpose of supporting the head of a baby being carried in the carrier 500 and can be lowered by connecting the neck clasp 507 with the lowering clasp 509. For example, the first 346 and second 347 head clips of the harness 300 can be coupled together and positioned over top of the carrier 100 underneath or proximate to the lowering clasps 509 or the neck clasps 507.

In an embodiment, the lower body 510 can sit on the waist of a wearer and place the weight of the baby on the waist rather than the lower back, similar to a hiking backpack. For example, the lower body 510 can wrap around the waist of a wearer and couple to itself via first 511 and second 512 carrier clips. As shown, the second carrier clip 512 can be coupled to or extend from an adjustable carrier strap 514 to allow for different sized users to wear the carrier 300. The carrier 300 can further include third 515 and fourth 520 carrier clips that, as discussed above, couple to the fifth 320 and sixth 325 harness clips of the harness 300 at an upper portion thereof. Further, the carrier 300 can include fifth 525 and sixth 530 carrier clips that couple to the seventh 330 and eighth 335 harness clips of the harness 300. The carrier 500 can also include a carrier pouch 545 enclosed by a carrier fastener 550.

The clip arrangement of the above-described embodiments allows a user to wear the bag 100 and carrier 500 at the same time, but if desired, to remove the bag 500 and rest while still carrying the carrier 500 with the baby inside. The user could also carry the bag 100 as a conventional backpack when not carrying a baby, and detach the carrier 500 from the harness 300 to achieve this. The wearer can therefore travel and rest without carrying the weight of the bag 100 or can use the bag 100 in a more versatile manner.

Figure 7:
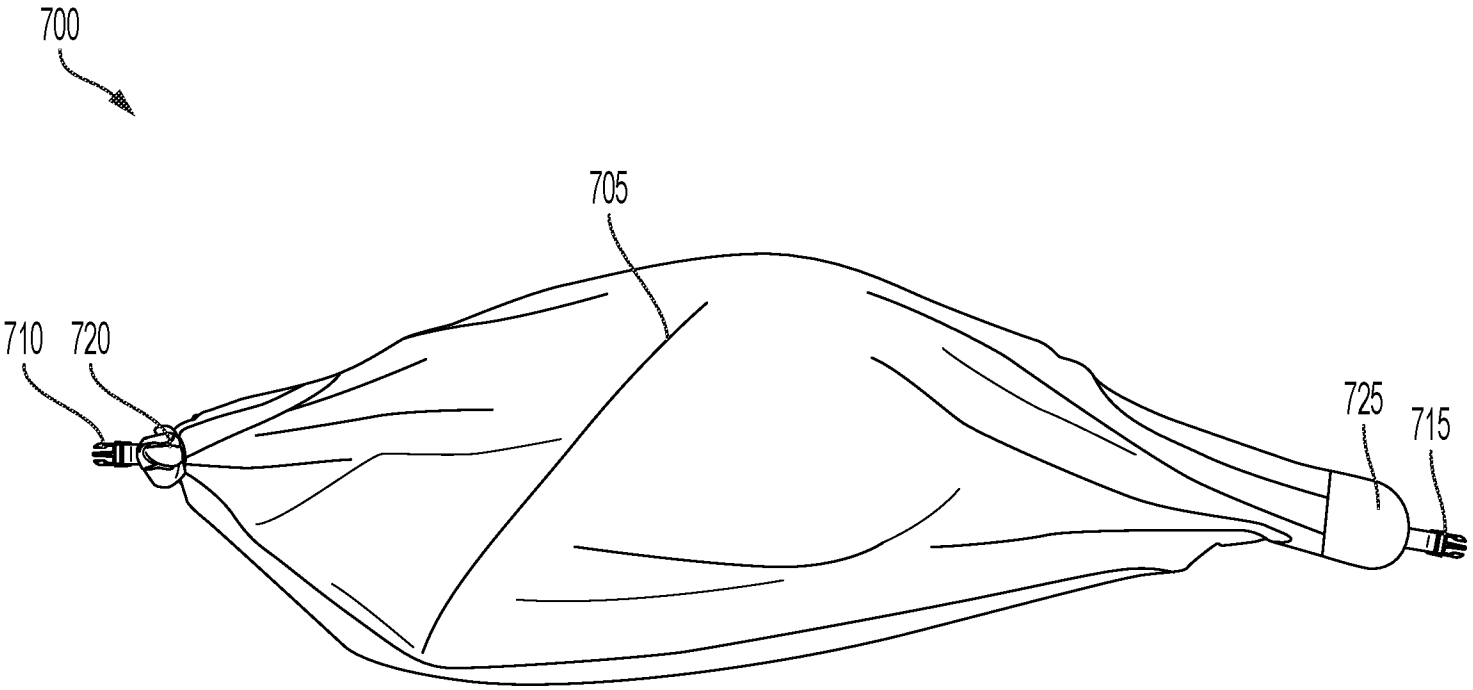
FIG. 7 is a top view of a sling carrier according to at least some of the presently disclosed embodiments.
Figure 8:
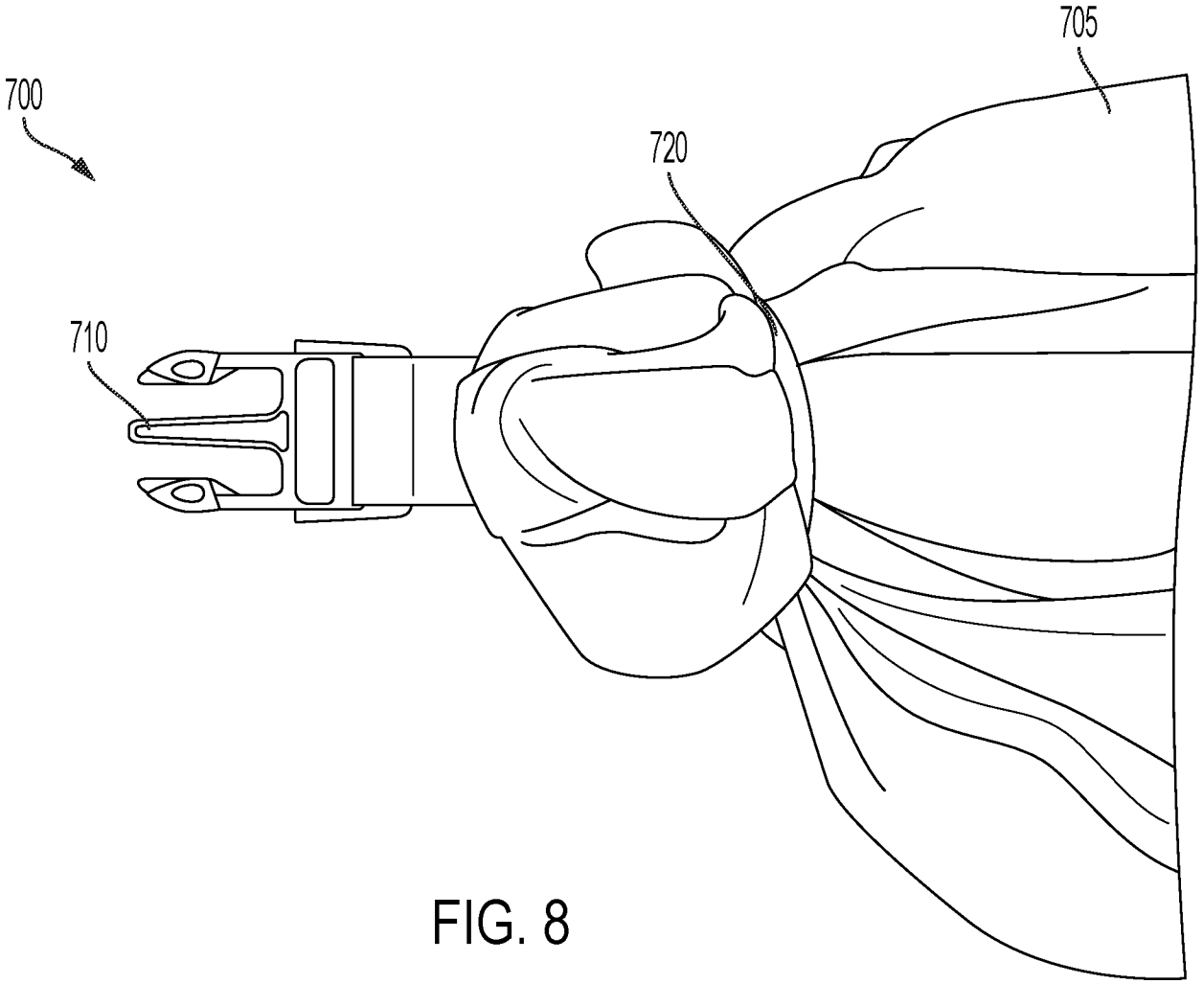
FIG. 8 is an enlarged view of a clip of the sling carrier according to at least some of the presently disclosed embodiments.
Figure 9:
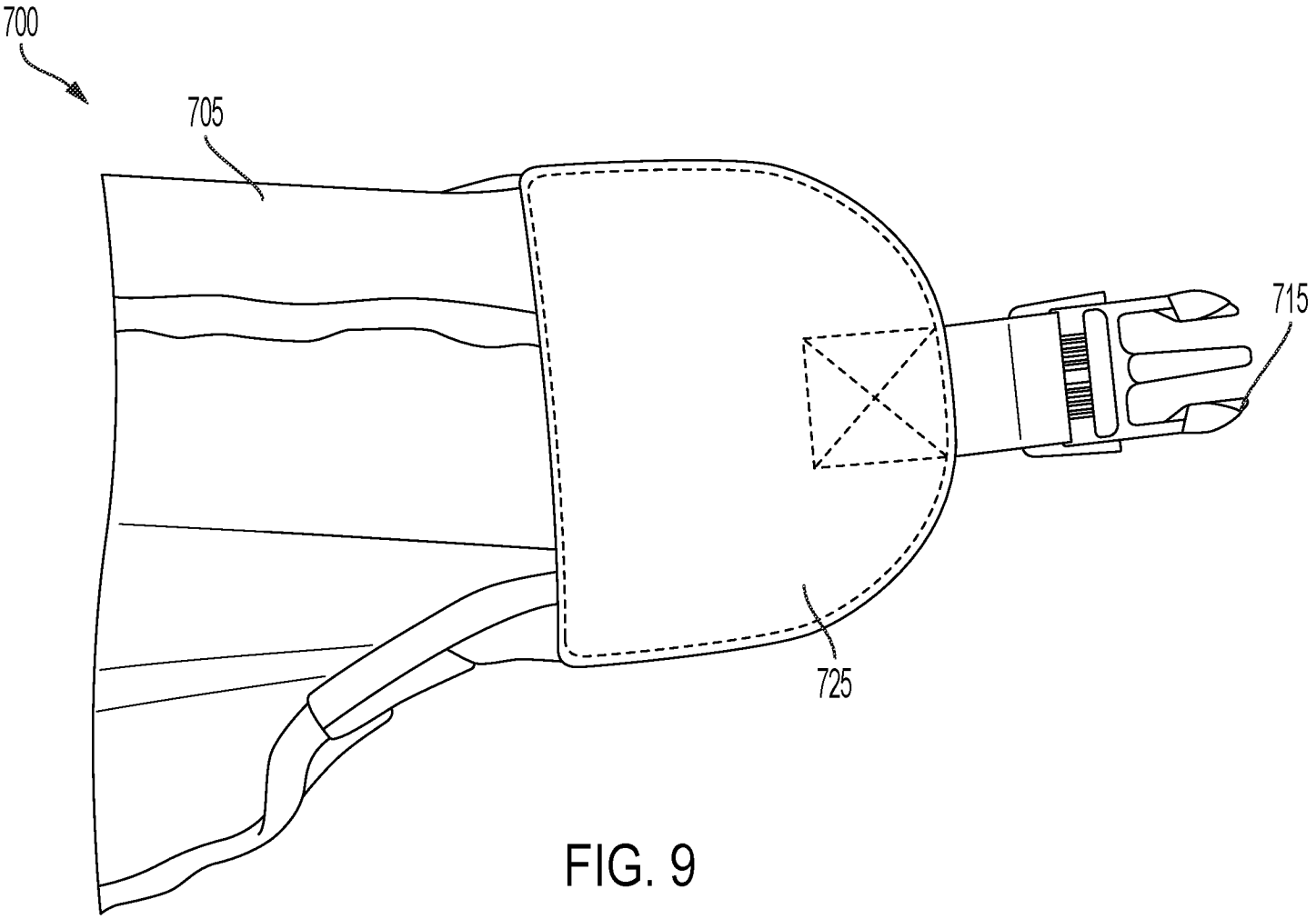
FIG. 9 is an enlarged view of another clip of the sling carrier according to at least some of the presently disclosed embodiments.

FIG. 7 is a top view of a sling carrier 700 according to at least some of the presently disclosed embodiments. The sling carrier 700 couples to the harness 300 at one end and allows the wearer to wrap their baby in a sling-type arrangement before coupling the opposite end of the sling carrier to the harness 300. For example, the sling carrier 700 can include a sling body 705 made of cloth and coupled with a first sling clip 710 and a second sling clip 715 at opposite ends of the sling body 710. The first 710 and second 715 sling clips can respectively couple to the fifth 320 and sixth 325 harness clips of the harness 300. As shown in FIG. 8, the first sling clip 710 can be located proximate a D-ring 720 that is used for adjusting the length of the sling body 705 during use. Further, and as shown in FIG. 9, the second sling clip 715 can be coupled to a non-adjustable extension 725 that acts as an anchor for the remainder of the sling carrier 700.

The figures show various clips as being male or female, and respectively connecting to female or male clips. However, one of ordinary skill would appreciate that the clips shown as female can be male, and vice versa.

Some of the harnesses shown are disclosed as being associated with a particular bag, but any of the harnesses can be implemented with any of the bags without departing from the spirit and scope of the present invention.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A combination comprising:
- a bag having front and rear sides and including:
  - first and second shoulder straps removably coupled to the bag on the front side via shoulder strap clips;
  - first and second bag clips extending from the front side on an upper portion thereof;
- a carrier comprising:
  - a main body having upper and lower sides;
  - a lower body extending from the main body on the lower side;
  - first and second carrier clips extending from the upper side and coupling with the first and second bag clips; and
  - third and fourth carrier clips extending from the lower body and coupling together around the waist of a wearer.

2. The combination of claim 1, wherein the first and second bag clips are coupled to the first and second shoulder straps.

3. The combination of claim 1, wherein the first and second shoulder straps are located on a harness of the bag.

4. The combination of claim 3, wherein the harness is removable from the bag.

5. The combination of claim 4, wherein the bag includes bag snaps extending from the main compartment on the front side, and wherein the harness includes harness snaps extending from the first and second shoulder straps and corresponding to and configured to couple to the bag snaps.

6. The combination of claim 4, wherein the bag includes third and fourth bag clips extending below the first and second bag clips, and wherein the harness includes third and fourth harness clips configured to couple to the third and fourth bag clips.

7. A combination comprising:
- a bag having front and rear sides and including:
  - first and second shoulder straps removably coupled to the bag on the front side via shoulder strap clips;
  - first and second bag clips extending from the front side on an upper portion thereof; and
- a wrap carrier comprising:
  - a wrap body made of fabric; and
  - first and second wrap carrier clips extending from opposite sides of the wrap body and configured to couple to the first and second shoulder straps.

8. The combination of claim 7, wherein the wrap carrier further comprises an adjustable D-ring located proximate to the first wrap carrier clip.

9. The combination of claim 7, wherein the wrap carrier further comprises a non-adjustable extension extending from the second wrap carrier clip.

10. The combination of claim 7, wherein the first and second bag clips are coupled to the first and second shoulder straps.

11. The combination of claim 7, wherein the first and second shoulder straps are located on a harness of the bag.

12. The combination of claim 11, wherein the harness is removable from the bag.

13. The combination of claim 12, wherein the bag includes bag snaps extending from the front side, and wherein the harness includes harness snaps extending from the first and second shoulder straps and corresponding to and configured to couple to the bag snaps.

14. The combination of claim 12, wherein the bag includes third and fourth bag clips extending below the first and second bag clips, and wherein the harness includes third and fourth harness clips configured to couple to the third and fourth bag clips.

* * * * *